US008455411B2

(12) United States Patent
Kilthau et al.

(10) Patent No.: US 8,455,411 B2
(45) Date of Patent: Jun. 4, 2013

(54) LUBRICANT COMPOSITION BASED ON NATURAL AND RENEWABLE RAW MATERIALS

(75) Inventors: Thomas Kilthau, Geretsried (DE); Martin Schmidt-Amelunxen, Röhrmoos/Arzbach (DE); Sarah Zirkel, München (DE)

(73) Assignee: Klüber Lubrication München KG, München (DE)

( * ) Notice: Subject to any disclaimer, the term of this patent is extended or adjusted under 35 U.S.C. 154(b) by 50 days.

(21) Appl. No.: 12/737,144

(22) PCT Filed: Jun. 9, 2009

(86) PCT No.: PCT/EP2009/004147
§ 371 (c)(1),
(2), (4) Date: Feb. 3, 2011

(87) PCT Pub. No.: WO2009/149902
PCT Pub. Date: Dec. 17, 2009

(65) Prior Publication Data

US 2011/0124537 A1 May 26, 2011

(30) Foreign Application Priority Data

Jun. 13, 2008 (DE) ..... 10 2008 028 339
May 26, 2009 (DE) ..... 10 2009 022 593

(51) Int. Cl.
*C10M 101/04* (2006.01)
*C10M 109/02* (2006.01)

(52) U.S. Cl.
USPC ..... 508/456; 508/452

(58) Field of Classification Search
USPC ..... 508/452, 456
See application file for complete search history.

(56) References Cited

U.S. PATENT DOCUMENTS 4,327,030 A * 4/1982 McVay et al. ..... 554/212
6,576,298 B2 * 6/2003 Bennett et al. ..... 427/424
2004/0241309 A1 * 12/2004 Garmier ..... 426/601

* cited by examiner

*Primary Examiner* — Pamela H Weiss
*Assistant Examiner* — Taiwo Oladalpo
(74) *Attorney, Agent, or Firm* — Kubovcik & Kubovcik

(57) ABSTRACT

The invention relates to a lubricant composition based on modified, natural and renewable raw materials, the viscosity of which can be adjusted according to the application. The invention relates more particularly to biodegradable lubricant compositions.

8 Claims, 4 Drawing Sheets

Note: Standard lubrication; Machine 5

LUBRICANT COMPOSITION BASED ON NATURAL AND RENEWABLE RAW MATERIALS

Figure 1:
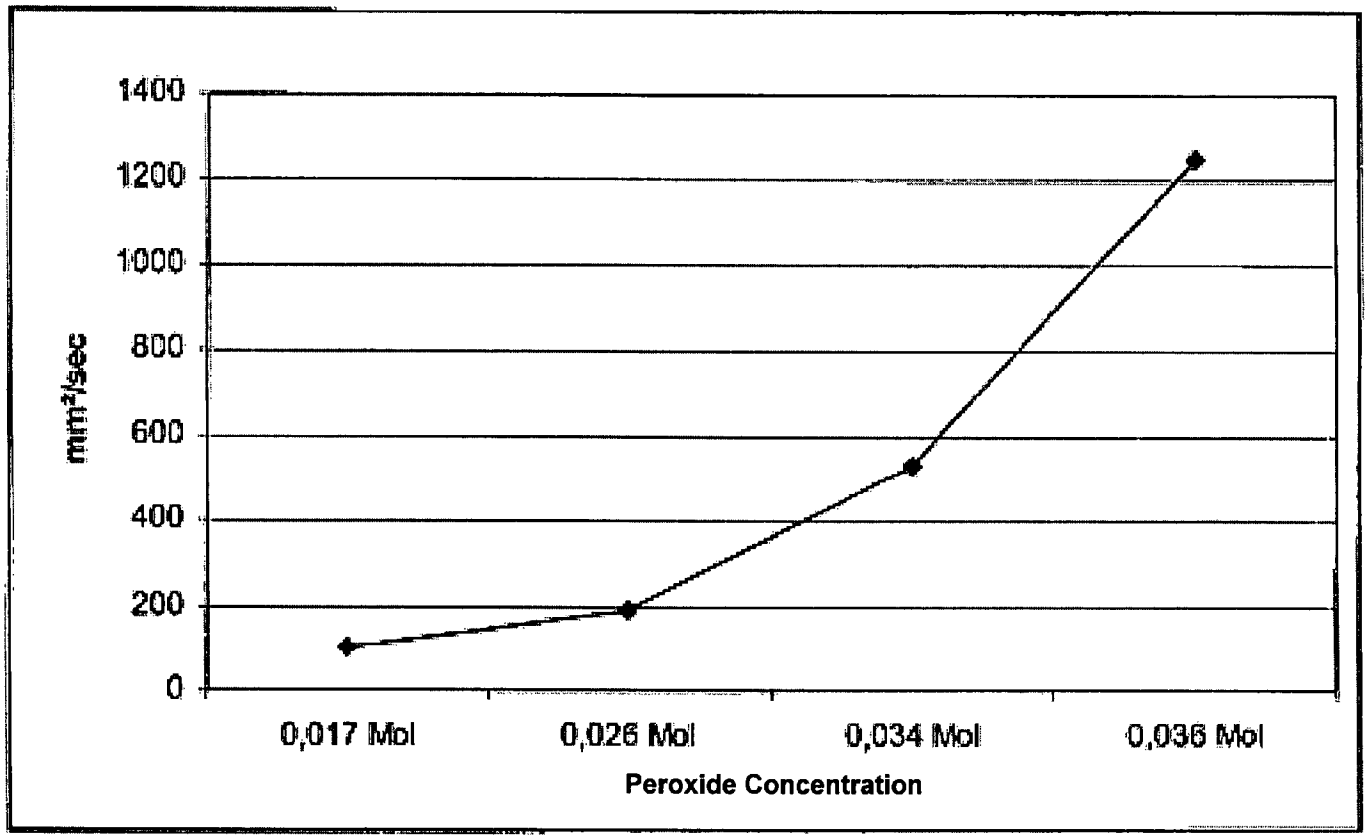

This application is a 371 of international application PCT/EP2009/004147, filed Jun. 9, 2009, which claims priority based on German patent application Nos. 10 2008 028 339.8 and 10 2009 022 593.6 filed Jun. 13, 2008, and May 26, 2009, respectively, and which are incorporated herein by reference.

The invention relates to a lubricant composition based on modified natural and renewable raw materials, the viscosity of which can be adjusted according to the application. The invention relates more particularly to biodegradable lubricant compositions.

From DE 103 29 761 A1, it is known to modify natural and renewable oils using ionizing radiation. In this, the ionizing radiation exerts its effect over several periods of exposure, wherein rest periods are provided between these treatment steps. This modification reaction is run with the addition of initiators, such as chemically catalytic additives, complex chemical compounds and/or organic accelerators. It is also known that the degree of modification of the oils to be treated with the ionizing radiation is influenced by the dosing, the temperature, the dose rate, by oxygen and by the effect of initiators or inhibitors. However, one drawback of the known modification methods is that they cannot be implemented on a large industrial scale and generally do not produce fully reproducible results.

Thus U.S. Pat. No. 4,327,030 A describes a method for modifying native triglyceride-based oils, wherein said oils are made to react with peroxide at a temperature of 100 to 200° C. The polymerized polyunsaturated fatty acid esters are isolated in the resulting residue and disposed of. This process serves to reduce the linoleic acid content, thereby increasing the oleic acid content. Therefore, the result is an oil that has a higher oleic acid content.

The natural oxidation of vegetable oils is also described. Principally, reference is made to the effective lubricating property of natural triglycerides. However, this property is severely limited because these oils tend strongly toward oxidation due to their high covalent bond content, therefore their areas of application are also severely limited. Moreover, oxidative residues can lead to the failure of components, for example, roller bearings, as a result of wear and tear.

In order to improve the resistance of these oils to oxidation, it has been proposed to replace said oils with phenolic and aromatic amine oxidation inhibitors, or to add oil-soluble copper compounds to said oils.

Due to the growing scarcity of crude oil, the mineral oil components of which continue to be used as basic materials in the production of lubricant compositions, it will be necessary in the future to replace these mineral oil constituents with renewable raw materials. However, the low viscosity of native oils based on natural and renewable raw materials limits their use as lubricants to a few areas of application.

One problem addressed by the present invention is to prepare a lubricant composition based on native renewable triglyceride-based oils, the viscosity of which can be adjusted according to the desired application. A further problem addressed by the present invention is to prepare a lubricant composition which contains the modified native oils, and which exhibits advantageous tribological properties at extreme temperatures in the high and low temperature ranges and is resistant to oxidation.

This problem is solved by a lubricant composition in which native triglyceride-based oils are made to react with peroxides, and the unsaturated portions of the fatty acids are bonded to one another by means of a radical addition reaction. This reaction alters the viscosity of the modified oil. The viscosity can be adjusted to the desired level based upon the peroxide/oil ratio, and can thereby be adapted to the requirements of the respective application. Depending upon the viscosity of the modified oil, the lubricant composition can be used as an NLGI grade 000, 00 fluid grease, and as a fluid grease for central lubricating systems and within the framework of gear lubrication, or as a soft grease of NGLI grades 1 to 4 in plain bearings, roller bearings, and for water pumps, or as so-called harder greases of NLGI grades 5 and 6, as gasket or briquetted greases.

The lubricant compositions of the present invention are based upon a method for modifying the viscosity of a native triglyceride-based oil, wherein the native oil is made to react with a peroxide compound at a temperature of 165° C. to 190° C. for 3 to 5 hours, after which the unsaturated covalent bonds are linked by a radical addition reaction. The by-products produced during polymerization are then removed in a high vacuum. The oils with modified viscosity produced in this manner can then be further processed in situ to produce lubricants. To react the native oil with the peroxide compound, 4.8% to 10.3% of the corresponding peroxide compound is used, depending upon the desired viscosity of the oil to be produced. The result is an oil having a viscosity of 100 to 1250 $mm^2$/sec. FIG. 1 illustrates viscosity as a function of peroxide concentration. Accordingly, by using different quantities of peroxide compound, both a high-viscosity oil and a low-viscosity oil can be produced in an easily reproducible manner.

Both aromatic and aliphatic peroxide compounds can be used as peroxides. Preferably, the peroxide compound is chosen from the group comprising 1,3-bis(tert-butylperoxy-isopropyl)benzene, 1,4-bis(tert-butylperoxy-isopropyl)benzene, dicumyl peroxide, tert-butyl cumyl peroxide, 2,5-dimethyl-2,5-di-(tert-butylperoxy)hexane, n-butyl-4,4'-di(tert-butylperoxy)valerate, 1,1'-di-(tert-butylperoxy)-3,3,5-trimethylcyclohexane, 2,5-dimethyl-2,5-di-(tert-butylperoxy)hexane. Particularly preferred are aliphatic peroxide compounds, such as 2,5-dimethyl-2,5-di-(tert-butylperoxy)hexane or di-tert-butyl peroxide, for example.

For reaction with the aforementioned peroxides, and for the subsequent radical addition reaction, oils having a high ratio of unsaturated components, which can be mono- or polyunsaturated, are particularly well suited. Vegetable oils having a high oleic acid content are particularly well suited. Olive oil having an oleic acid content of 65% to 85% is particularly well suited as a natural, non-genetically modified oil. Also preferred are vegetable oils having an oleic acid content of at least 60%. These can also be genetically modified to increase the oleic acid content. The native oils are chosen from the group comprising safflower oil with a high oleic acid content, corn oil with a high oleic acid content, rapeseed oil with a high oleic acid content, sunflower oil with a high oleic acid content, soybean oil with a high oleic acid content, flaxseed oil with a high oleic acid content, peanut oil with a high oleic acid content, "lesquerella" oil with a high oleic acid content, palm oil with a high oleic acid content, castor oil with a high oleic acid content, linseed oil with a high oleic acid content, or olive oil with a high oleic acid content, and mixtures of the aforementioned oils.

The modified oils obtained in this manner, which have a higher viscosity as compared with the starting oils, are cost-effective in terms of their tribological properties, their resistance to oxidation, and their range of applications at temperatures of −30° C. to 180° C., and can be produced in a reproducible manner. They have the advantage over mineral oils that they are biodegradable and have limitless availability.

As was described above, using the unsaturated components in the oils, through the reaction with peroxide, the unsaturated fatty acids are fully or partially bonded to one another via a radical addition reaction. In this process, the degree of polymerization of the modified oil is based upon the ratio of the oil to the peroxide. Reaction temperature and reaction time also influence the degree of polymerization. The behavior of the modified oils obtained in this manner is greatly improved at low temperatures, however, said oils can also be used at high temperatures, and have a very high VI, of >210. They also have very advantageous tribological properties and superior resistance to oxidation.

The lubricant compositions based on native, modified oils of the present invention have polar properties and can be applied to metallic surfaces as thin adhesive films, whereby an excellent lubricating effect can be achieved. In contrast to lubricants that have a mineral oil or hydrocarbon base, said lubricating film cannot be easily separated from the metal surface, which expands the range of applications of the lubricants according to the invention to include hydraulic applications. In particular, they are more stable than linear hydrocarbon compositions against thermal and mechanical stresses, due to their cross-linked structure.

The highly viscous oils based on renewable raw materials are also suitable for fully or partially replacing the "bright stock," which is used as a basic component in many lubricants.

In summary, the advantages of lubricant compositions with modified native triglyceride-based oils are that they are produced from renewable raw materials, and that their base materials are biodegradable and non-toxic, have high flash points, are thermally stable, and have superior low temperature behavior. They also adhere better to metallic surfaces.

The kinematic viscosity of renewable and natural oils, as described in what follows, ranges from 100 to 1250 $mm^2$/sec at 40° C., depending upon the intended use of the lubricant composition.

The lubricant composition produced using the modified, native oil comprises (a) 50 to 90 wt % a modified, native triglyceride-based oil with a high oleic acid content, chosen from the group comprising sunflower oil, rapeseed oil, castor oil, linseed oil, corn oil, safflower oil, soybean oil, flaxseed oil, peanut oil, "lesquerella" oil, palm oil, olive oil, or mixtures of the aforementioned oils, wherein the native oil is made to react with a peroxide, and the unsaturated covalent bonds are linked by a radical addition reaction, and (b) 5 to 10 wt % additives or additive mixtures, wherein the viscosity of the modified native oil ranges from 100 to 1250 $mm^2$/sec.

A lubricant composition of this type is preferably used as transmission oil.

The lubricant composition can further (c) contain 5 to 30 wt % thickening agent.

A composition of this type is ordinarily used as fluid grease.

If the lubricant composition also contains (d) 5 to 10 wt % solid lubricants, in addition to components (a) to (c), it can preferably be used as fluid gear grease.

As was already described above, it is possible to replace a portion of the "bright stock" with the modified native oil. A lubricant composition of this type also contains (e) 5 to 45 wt % an additional crude oil component or multiple crude oil components, in addition to the components (a) to (d).

The thickening agent of the lubricant composition is chosen from the group comprising urea, aluminum complex soaps, metallic simple soaps of elements of the $1^{st}$ and $2^{nd}$ main groups of the periodic table, metallic complex soaps of elements of the $1^{st}$ and $2^{nd}$ main groups of the periodic table, bentonite, sulfonate, silicate, polyimide or PTFE, or a mixture of the aforementioned thickening agents.

The solid lubricant is chosen from the group comprising graphite, boron nitride, $MoS_2$, $WS_2$, SnS, $SnS_2$, or $Bi_2S_3$, or a mixture of the aforementioned solid lubricants.

The additive or additive mixture is chosen from the group comprising butyl hydroxy toluene, dialkyl diphenylamines, alkylated phenyl-alpha-naphthylamines, polymeric trimethyl dihydroquinoline, sulfurized fatty acid esters, diphenyl cresyl phosphate, amine-neutralized phosphates, alkylated and non-alkylated triaryl phosphates, alkylated and non-alkylated triaryl thiophosphates, zinc-dialkyl dithiophosphates, carbamates, thiocarbamates, zinc-dithiocarbamates, dimercaptothiadiazole, succinic acid semi-ester, calcium sulfonates, benzotriazole derivatives, K-pentaborates, Na-thiosulfates, and Na-pyrophosphates.

The crude oil component of the lubricant composition is chosen from the group comprising paraffin-based and naphthene-based mineral oils, synthetic hydrocarbons, poly-alpha olefin (PAO), poly-internal olefin (PIO), ethylene-propylene copolymers, group III oils, synthetic esters, polyalkylene glycols or alkyl aromatics, and mixtures thereof.

It is particularly advantageous that the oil is made to react with the peroxide prior to use, and then the corresponding additives, such as thickening agents like silicates, sulfonates, polyimides, metallic soaps, metallic soap complexes, ureas, and bentonites, are added in situ to the already polymerized oil. The polymerized oils can also be mixed with other crude oil components, such as paraffin-based and naphthene-based mineral oils, synthetic hydrocarbons (poly-alpha olefin, poly-internal olefin, ethylene-propylene copolymers), group III oils, synthetic esters, polyalkylene glycols (PAG), and alkyl aromatics, in lubricant formulations. Customary anti-wear additives and solid lubricant additives such as triaryl phosphates, triaryl thiophosphates, zinc dialkyl dithiophosphates, carbamates, thiocarbamates, zinc-dithiocarbamates, $MoS_2$, graphite, boron nitride, PTFE, Na-thiosulfates, Na-pyrophosphates, etc., can be used here. Phenolic and aminic antioxidants are customarily used as antioxidants, wherein polymerized trimethyl dihydroquinoline or sulfurized fatty acid esters are preferably used.

Advantageously, the lubricant compositions according to the invention can be rapidly and reproducibly mixed, shortly before use, in a so-called one-pot reaction.

Figure 2:
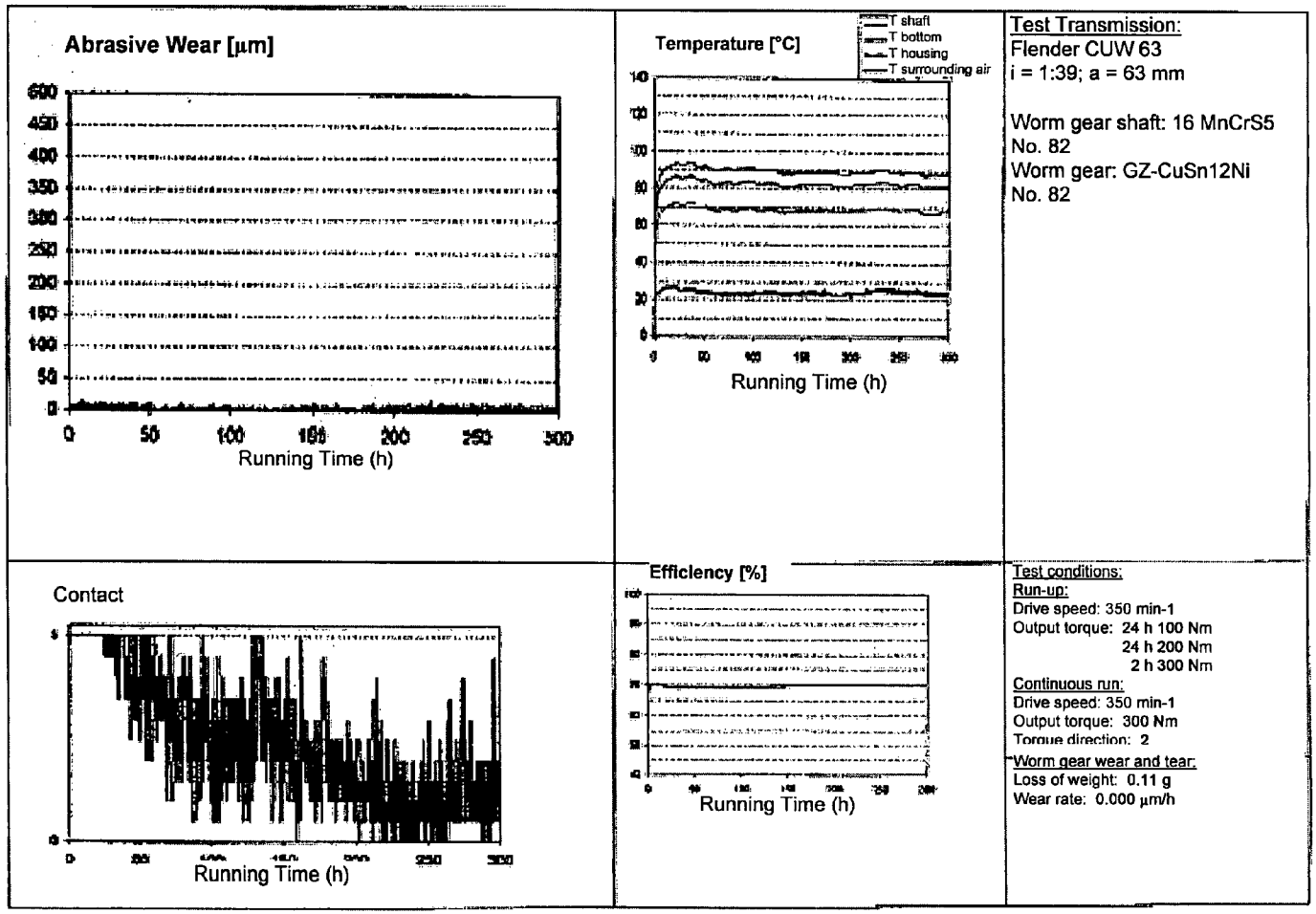

In what follows, the use of the lubricant composition according to the invention as transmission oils for a worm gear will be described. Together with suitable phosphorous-based and sulfur-based additives, along with butyl hydroxy toluene, dialkyl diphenylamine, diphenyl cresol phosphate, amine-neutralized phosphate, succinic acid semi-ester, and triazole derivative, a polymerized sunflower oil with a high oleic acid content, which is based upon the ISO VG 460 standard, is developed. The ratio of the aforementioned additive mixture is approximately 6%. The lubricant composition is tested on a worm gear test stand for 300 hours. This study showed that the modified sunflower oil has an efficiency level of 70 to 80%, and therefore achieves the efficiency level of traditional transmission oils having a polyalpha olefin- and polyalkylene glycol base. With respect to a reduction in wear and tear, and the rapid build-up of a hydrodynamic lubricating film at the point of friction, the lubricant composition according to the invention far outperforms conventional transmission oils. The results shown in FIG. 2, which were obtained on the worm gear test stand, support this.

More particularly, the very low abrasive wear over the running time of 300 h and the very rapidly onset hydrodynamic lubrication emphasize the advantageous lubricating properties of a native transmission oil of this type.

Figure 3:
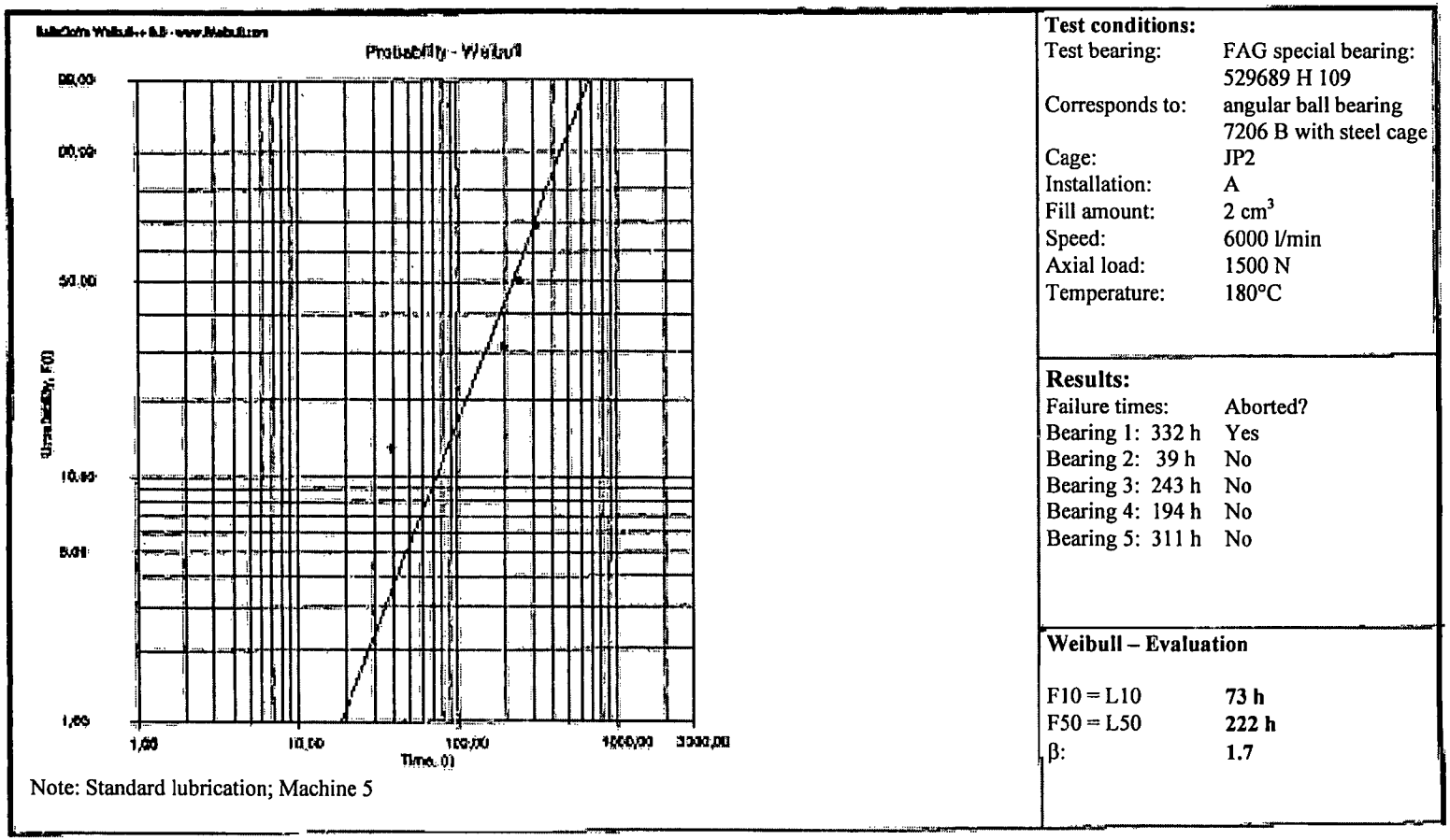

As a further example of the lubricant composition according to the invention, a urea grease of NLGI grade 1 was developed. This roller bearing grease contains 52 wt % ISO VG 460 polymerized, modified sunflower oil having a high oleic acid content, 38.3 wt % mineral oil (bright stock), along with 6.59 wt % thickening agent and 3.05 wt % an additive mixture consisting of Zn-dialkyl dithiophosphate, sulfurized fatty acid ester, benzotriazole and antioxidant, for thermal stabilization. This grease concept makes it possible to achieve L 50 values of >100 h on the FE9 test machine at 140° C. FIG. 3 shows the test conditions and results of the FE9 test.

Figure 4:
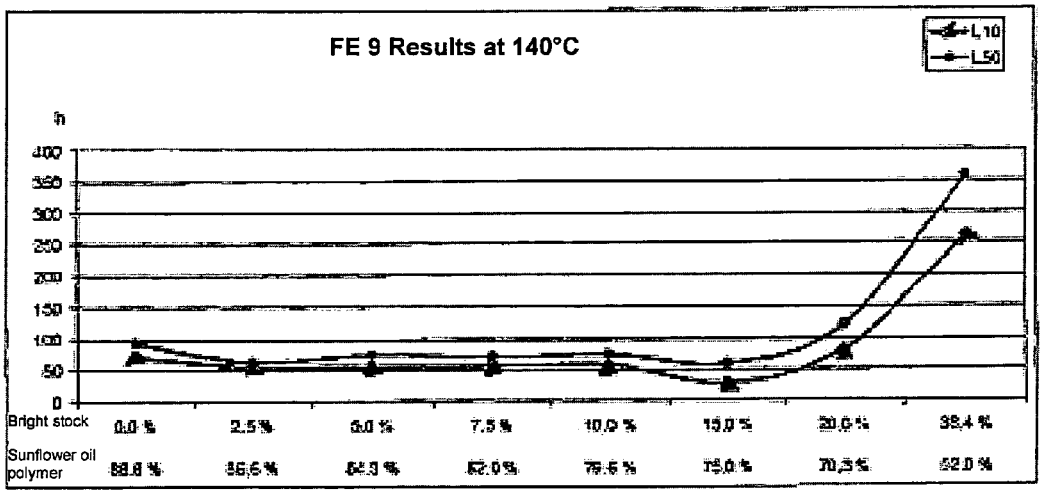

As is clear from the results shown in FIG. 4, even with a bright stock content of <20% running time can be extended significantly, and the modified sunflower oil can be thermally stabilized using suitable additives.

One example of a colorless, biodegradable fluid transmission oil is a composition consisting of a modified sunflower oil, to which a calcium soap has been added as thickening agent, which oil has a viscosity of 700 $mm^2$/sec at 40° C. Said lubricant composition has been compared with a lubricant composition having a mineral oil base and an aluminum soap as thickening agent, and also containing graphite as a solid lubricant.

wt % modified sunflower oil polymer having a kinematic viscosity of 100 to 1250 $mm^2$/sec at 40° C., particularly from 350 to 550 $mm^2$/sec at 40° C., and 30 to 10 wt % a lithium-based soap, wherein the constituents are mixed together directly prior to application, producing a grease of NLGI grade 0 to 2, and wherein the lithium-based soap is produced by the direct saponification of modified sunflower polymer using $LiOH \times H_2O$ in a 1:1 molar ratio. A kit of this type can be used, for example, in plain bearings.

The invention claimed is:

1. A lubricant composition comprising (a) 50 to 90 wt % a modified, native triglyceride-based oil with a oleic acid content of at least 60%, chosen from the group consisting of sunflower oil, rapeseed oil, castor oil, linseed oil, corn oil, safflower oil, soybean oil, flaxseed oil, peanut oil, "lesquerella" oil, palm oil, olive oil, and mixtures of the aforementioned oils, wherein the native oil is made to react with a peroxide, and the unsaturated covalent bonds are linked by a radical addition reaction, and (b) 5 to 10 wt % additives or additive mixtures, (c) 5 to 30 wt % thickening agent, wherein the kinematic viscosity of the modified native oil ranges from 100 to 1250 $mm^2$/sec at 40° C.

2. The lubricant composition of claim 1, also containing (d) 5 to 10 wt % solid lubricants.

TABLE 1

| Method Name/Standard | Conditions | Parameter | Standard Fluid Grease | Biodegradable Fluid Grease |
|---|---|---|---|---|
| Chemical Composition | | Crude oil(s) | Mineral oil | Polymerized sunflower oil |
| | | Thickening agent | Aluminum soap | Calcium soap |
| Crude oil viscosity | | Kin. visc. 40 degrees ($mm^2$/s) | 700 | 700 |
| FZG | Damaging force stages; | Damaging force stage | >12 | >12 |
| | Continuous test 30 h | Wear and tear after 30 h | <0.2 mg/kwh | <0.05 mg/kwh |
| Cone penetration based upon DIN ISO 2137 | Number of double strokes: 60 | Penetration depth (0.1 mm) | 370 | 372 |
| | Test temperature: 25° C. | | | |
| | Cone: Quarter cone | 2-3 | | |
| Visual assessment | | | | |
| | | Color | Black with graphite | Bright beige without graphite |
| | | Structure | No air pockets | Homogeneous, short stretch |
| | | Appearance | No air pockets | No air pockets |
| Emcor | Medium: Deionized $H_2O$ | Degree of corrosion | 2 | 2-3 |
| | | Assessment | LV | LV |
| Lubricating properties/adhesive properties at low temperatures AA 558 Part 1; 2; 3; 4; 5 | Cooling time: 18 h | Evaluation | No tears or scaling | No tears or scaling |
| | Temperature: −20° C. | | | |
| | Temperature: −20° C. | | | |
| VKA sustained wear and tear | Process: 400N | Ball impression diameter (mm) | 0.78 | 0.47 |
| VKA sustained wear and tear | Process: 1000 (E 1 min) N | Ball impression diameter (mm) | 0.66 | 0.44 |
| VKA | | Product strength (N) | 6500 | 8000 |
| | | Welding force (N) | 7000 | 8500 |
| Water resistance | Test temperature: 40° C. | Evaluation stage | 0 | 0 |

As is shown in Table 1, the lubricating grease composition of the present invention, which is based on a biodegradable, modified sunflower oil, produces the same, if not better, results than a standard fluid grease. Furthermore, it is biodegradable and colorless, i.e., a solid lubricant like graphite can be dispensed with. Therefore, customer demand for greases that are not black can be met.

A further use of the modified native triglyceride-based oils involves their use in an application kit containing 70 to 90

3. The lubricant composition according to claim 1, in which 5 to 45 wt % of the native modified oil is replaced by an additional crude oil component or multiple crude oil components.

4. The lubricant composition according to claim 1, in which the thickening agent is chosen from the group consisting of urea, aluminum complex soaps, metallic simple soaps of elements of the 1st and 2nd main groups of the periodic table, metallic complex soaps of elements of the 1st and 2nd main groups of the periodic table, bentonite, sulfonate, silicate, polyimide or PTFE, and a mixture of the aforementioned thickening agents.

5. The lubricant composition according to claim 2, in which the solid lubricant is chosen from the group consisting of graphite, boron nitride, $MoS_2$, $WS_2$, SnS, $SnS_2$, or $Bi_2S_3$, and a mixture of the aforementioned solid-lubricants.

6. The lubricant composition according to claim 1, in which the additive or additive mixture is chosen from the group consisting of butyl hydroxy toluene, dialkyl diphenylamines, alkylated phenyl-alpha-naphthylamines, polymeric trimethyl dihydroquinoline, sulfurized fatty acid esters, diphenyl cresyl phosphate, amine-neutralized phosphates, alkylated and non-alkylated triaryl phosphates, alkylated and non-alkylated triaryl thiophosphates, zinc-dialkyl dithiophosphates, carbamates, thiocarbamates, zinc-dithiocarbamates, dimercaptothiadiazole, succinic acid semi-ester, calcium sulfonates, benzotriazole derivatives, K-pentaborates, Na-thiosulfates, and Na-pyrophosphates.

7. The lubricant composition according to claim 3, in which the crude oil component is chosen from the group consisting of paraffin-based and naphthene-based mineral oils, synthetic hydrocarbons, poly-alpha olefin, poly-internal olefin, ethylene-propylene copolymers, group III oils, synthetic esters, polyalkylene glycols and alkyl aromatics, and mixtures thereof.

8. The lubricant composition according to claim 1, in which the native oil is made to react with an aromatic or aliphatic peroxide is chosen from the group consisting of 1,3-bis(tert-butylperoxy-isopropyl)benzene, 1,4-bis(tert-butylperoxy-isopropyl)benzene, dicumyl peroxide, tert-butyl cumyl peroxide, 2,5-dimethyl-2,5-di-(tert-butylperoxy)hexane, n-butyl-4,4'-di(tert-butylperoxy)valerate, 1,1'-di-(tert-butylperoxy)-3,3,5-trimethylcyclohexane, and 2,5-dimethyl-2,5-di-(tert-butylperoxy)hexane and di-tert-butyl peroxide.

* * * * *